US006025821A

United States Patent [19]

Mart

[11] Patent Number: 6,025,821

[45] Date of Patent: Feb. 15, 2000

[54] DRIVE SYSTEM FOR VACUUM FLUORESCENT DISPLAY AND METHOD THEREFOR

[75] Inventor: Gregory A. Mart, Zeeland, Mich.

[73] Assignee: Prince Corporation, Holland, Mich.

[21] Appl. No.: 09/021,076

[22] Filed: Feb. 10, 1998

[51] Int. Cl.[7] ..... G09G 3/22; G09G 5/00

[52] U.S. Cl. ..... 345/75; 345/204

[58] Field of Search ..... 345/33, 47, 74, 345/75, 204, 205, 206; 313/495, 496, 497, 500; 315/169.3

[56] References Cited

U.S. PATENT DOCUMENTS

| | | | |
|---|---|---|---|
| 4,149,147 | 4/1979 | Kishino | 345/47 |
| 4,302,756 | 11/1981 | Frankland | 345/204 |
| 4,303,917 | 12/1981 | Kishino et al. | 345/75 |
| 4,486,749 | 12/1984 | Kishino et al. | 345/75 |
| 4,859,997 | 8/1989 | Bouron et al. | 345/59 |
| 4,868,555 | 9/1989 | Watanabe et al. | 345/75 |
| 4,885,628 | 12/1989 | Nagai et al. | 257/500 |
| 4,935,670 | 6/1990 | Watanabe | 345/75 |
| 5,036,247 | 7/1991 | Watanabe et al. | 313/496 |
| 5,202,674 | 4/1993 | Takemori et al. | 345/75 |
| 5,387,838 | 2/1995 | Hirakawa et al. | 345/75 |
| 5,510,672 | 4/1996 | Washio et al. | 345/75 |
| 5,541,478 | 7/1996 | Troxell et al. | 345/75 |
| 5,844,531 | 12/1998 | Betsui | 345/75 |

*Primary Examiner*—Jeffery Brier
*Assistant Examiner*—Paul A. Bell
*Attorney, Agent, or Firm*—Harness, Dickey & Pierce, P.L.C.

[57] ABSTRACT

The vacuum fluorescent display (VFD) system of the inventive invention includes a display matrix including an array of anodes, a processor, at least two anode drivers, and a grid driver to selectively activate the anodes of the display matrix. The system of the instant invention alternatingly disables some of the output gates of the two anode drivers so that the anodes in the outer columns of anodes associated with the activated grids are, preferably, pulled to ground, while the anodes in the inner columns of anodes of the activated grids may respond to the display data output from the anode driver output gates that are not currently disabled. Preferably, the output lines of each anode driver are connected to particular columns of anodes such that when successive grids are activated, thus enabling particular columns of anodes, at least some of the anode driver output gates are connected to the anodes in the outer columns of anodes in the activated grids, while the other anode driver output gates are connected to the anodes in the inner columns of anodes in the activated grids.

22 Claims, 5 Drawing Sheets

DRIVE SYSTEM FOR VACUUM FLUORESCENT DISPLAY AND METHOD THEREFOR

BACKGROUND OF THE INVENTION

1. Field of the Invention

The present invention relates to vacuum fluorescent display (VFD) systems having a plurality of anodes arranged in a matrix that may be selectively activated to display information. More particularly, the present invention relates to a method of driving a fluorescent display utilizing a quad-anode connection structure between the data drivers and the anodes to produce a high density and high clarity dot matrix display.

2. Discussion of Related Art

Vacuum fluorescent displays typically include a matrix of anodes that comprise the pixels of the display and at least one filament cathode that is positioned adjacent to the matrix of anodes and parallel to the plane defined by the matrix. When the system is activated, a power source heats the filament cathode, thus causing the filament to emit thermions that, in turn, are attracted toward activated anodes. Because the anodes are coated with a reactive material, the thermions that contact the activated anodes will cause those anodes to fluoresce. Therefore, by selectively activating the anodes, and thus causing those anodes to attract thermions, i.e., fluoresce, desired information may be displayed.

Typically, the anodes are selectively activated by a combination of signals from at least one anode driver and a grid driver. The anode and grid drivers, in turn, are controlled by a system processor that, among its many functions, transmits processed serial display data to the anode drivers and grid data to the grid driver. In the known display system 10 shown in FIG. 1, a matrix 12 of anodes 11 is arranged in a plurality of columns C1–C16. System 10 also has a series of adjacent grids 14 that are positioned between, and perpendicular to, the filament cathode (not shown) and matrix 12. Each grid 14 is associated with typically two equally spaced columns of closely spaced anodes 11 that extend from the top to the bottom of the display screen. When activated, grids 14 enable the anodes 11 associated therewith to fluoresce. If particular anodes 11 associated with activated grids 14 receive a logic "high" display data signal, the activated grids will attract and direct thermions emitted by the cathode toward those associated anodes 11 to insure that those anodes will fluoresce.

A system processor 20 transmits a control signal (described below) to a grid driver 40 that, in response, scans the columns of closely spaced anodes 11, typically from left to right, by sequentially activating pairs of grids 14 to enable the columns of anodes associated therewith. If particular "enabled" anodes in the currently activated grids 14 receive a logic "high" display data signal from their corresponding anode drivers 16, 18, those particular anodes will be activated and fluoresce while anodes receiving a logic "low" data signal will not be activated, and thus will not fluoresce. As grid driver 40 successively activates pairs of grids 14, active anodes (anodes associated with activated grids 14 that receive a logic "high" data signal from its corresponding anode driver) will fluoresce to display the desired display data. In other words, particular anodes will be illuminated by the combination of a scanning grid signal from grid driver 40 that activates grids 14 and enables corresponding anodes 11, and logic "high" display data signals from anode drivers 16, 18.

As shown in FIG. 1, display system 10 includes two anode drivers 16, 18 for sending data to anodes 11 of display matrix 12 via a plurality of output lines 36, 37. Two anode drivers are typically required for (an average relatively high) resolution dot matrix display due to the limited number of pins in a standard anode driver chip. A simplified 8×16 display is shown in FIG. 1 for ease of illustration. Displays of this type are typically much larger (e.g., 32×80) and the anodes are more closely spaced. In FIG. 1, one anode driver 16 transmits display data D1 signals to anodes 11 in the rows in the top half of the display matrix 12 via output lines 36 (left anode driver), and the other anode driver 18 transmits display data D2 to anodes 11 in the rows in the bottom half of display matrix 12 via output lines 37 (right anode driver). To accommodate both anode drivers, processor 20 of this system supplies serial display data D1, D2 via two output ports 22, 24.

In general, to display desired information, the display data D1, D2 is transmitted as a series of serial data bits to processor 20. Processor 20 thereafter sends the data to anode drivers 16, 18 via anode driver input ports 29, for display. (The following description is applicable to both anode drivers 16, 18 of system 10, but will be presented with respect to left anode driver 16 for illustrative purposes.) With reference to FIG. 3, anode driver 16 has a shift register 44 that receives the serial display data and stores the data one bit at a time in response to a clock signal CLK1 supplied to input port 28 from processor 20. The data is stored such that it subsequently may be output in parallel from shift register 44 to anodes 11. Then, as described in more detail below with respect to FIG. 2, processor 20 applies a strobe signal STBA to port 26 of anode driver 16, and specifically to a plurality of latch gates 45 therein corresponding to each data bit, to latch the shift register data to output lines 47 of latch gates 45, thus allowing shift register 44 to receive a new string of serial display data. As grid driver 40 scans, i.e., activates, pairs of grids 14, the display data is essentially simultaneously latched onto output lines 47, amplified by a series of amplifiers 49 and electrically coupled to corresponding anodes, causing those anodes in the activated grids to fluoresce. However, for the display data signals to be output to anodes 11 in this fashion, the anode drivers must be enabled. By applying a logic "low" data signal to the anode driver output enable (OE) input port 46, anode driver 16 will be enabled and the display data signals on output lines 47 will be electrically coupled through "AND" gates 48 to output lines 36. Note that input port 46 is inverted so that when processor 20 supplies a logic "low" data signal to that port, a logic "high" voltage is applied to "AND" gates 48. Typically, while the system is activated, anode drivers 16, 18 are continuously enabled either by a control signal or by a constant voltage (low) supplied to OE port 46.

Because grid driver 40 activates only two grids 14 at any instant in time (described in further detail below), anode drivers 16, 18 need only supply display data to the four columns of associated anodes at that time. Therefore, in a quad-anode connection structure, only four output lines 36, 37 need be provided per row of anodes 11 for an anode driver to supply display data to an entire row of anodes, so long as the display data on lines 36, 37 is changed in synchronism with the activation of each pair of grids. Thus, each four output lines 36, 37 associated with a row of anodes from one of anode drivers 16, 18 is connected to every fourth anode 11 in that associated row. For example, in the system of FIG. 1, output lines (a1, b1, c1, d1) 36 of left anode driver 16 are connected to the first four anodes 11 of the top row of anodes associated with the first two grids (G1 and G2) 14, each grid associated with two columns of anodes as described above. These same output lines (a1, b1, c1, d1) are connected in a similar fashion to the next four anodes in the top row of anodes, across grids G3 and G4, as well as across grids G5 and G6, and G7 and G8. This quad-anode connection is repeated for the connections between output lines 36 of left anode driver 16 and the top four rows of anodes. As a result, for simplified display 10 shown in FIG. 1, left anode driver 16 contains sixteen output lines 36 for selectively activating the top four rows of anodes 11. Similarly, right anode driver 18 has sixteen output lines 37 that are connected to the bottom four rows of anodes for selectively activating the bottom four rows of anodes.

With further reference to FIGS. 1, 2 and 3, operation of system 10 is described below. To display desired display data, processor 20 instructs grid driver 40 to scan grids G1–G8 14 while nearly simultaneously instructing anode drivers 16, 18 to transmit the display data, previously supplied by processor 20, to anodes 11 in matrix 12. Processor 20 initially loads grid data signals DG to a grid shift register (not shown) in grid driver 40 one bit at a time according to a grid clock signal CLKG applied to terminal 34. As discussed in further detail below, this grid data DG is strobed and latched to the output lines 42 of grid driver 40 to selectively scan grids 14. Then, processor 20 loads anode data D1 via port 22 (left anode driver 16) and D2 via port 24 (right anode driver 18) into corresponding anode shift registers 44 one bit at a time according to a clock signal CLK1 transmitted by processor 20 to each anode driver 16, 18.

With particular reference to the timing diagram shown in FIG. 2, after the grid and anode driver data has been loaded, but before the data has been strobed and latched to the respective output lines of drivers 16, 18, 40, processor 20 transmits a logic "high" grid blanking signal BLKG to grid driver 40 to disable all grids 14 corresponding to anodes 11 in matrix 12. With all grids 14 disabled, processor 20 applies an anode strobe signal STBA to a series of latch gates 45 in anode drivers 16, 18 via anode driver input ports 26, to latch anode data D1 and D2 from anode driver shift registers (44 for left anode driver 16, FIG. 3) to output lines 36, 37 of anode drivers 16, 18. Next, with all grids 14 still disabled, processor 20 transmits a grid strobe (latch) signal STBG to grid driver 40, thus latching grid data signals DG from grid shift register to a series of output lines of the latch gates (not shown) of grid driver 40 and allowing processor 20 to transmit the next string of grid data DG to the grid shift register. Finally, processor 20 pulls grid blanking signal BLKG to a logic "low" voltage level to place grid data DG on output lines 42 of grid driver 40, thus enabling the columns of anodes 11 associated with grids 14 activated by the grid data DG. When in this state, anodes associated with the activated grids will respond to data D1, D2 on output lines 36, 37 of anode drivers 16, 18, so long as the OE input port 46 of anode drivers 16, 18, connected to output lines 36, 37, is enabled.

One problem often associated with fluorescent display systems having closely spaced anodes is that the thermions emitted by the filament cathode sometimes "bleed" toward anodes that are associated with adjacent non-activated grids and that receive a logic "high" data signal, thus causing a "fuzzy" display. Even though the anodes 11 associated with inactive grids 14 are not enabled, those anodes are still susceptible to bleeding if they receive a logic "high" data signal from their respective anode drivers. To minimize this problem and provide a better defined, high quality display, some known systems, including system 10 shown in FIG. 1, use a quad-anode connection structure between anode drivers 16, 18 and anodes 11, in conjunction with a particular method of delivering the serial display data, including activating two grids 14 at a time, wherein selected columns of anodes 11 associated with the currently activated grids 14 are driven to a logic "low" voltage level while the remaining columns of anodes associated with the currently activated grids respond to the desired display data. To intentionally drive certain anodes "low" while allowing other anodes to respond to display data, such quad-anode display systems must modify the display data D1, D2 sent to anode drivers 16, 18.

More specifically, system 10 activates two grids 14 at a time by transmitting appropriate grid data signals DG to grid driver 40. Typically, grid data signals DG instruct grid driver 40 to successively activate adjacent pairs of grids, e.g., G1 and G2, G2 and G3, etc. As a result, system 10 may display four columns of data each time processor 20 transmits a logic "low" grid blanking signal BLKG, thus enabling grids G1–G8. For example, as grid driver activates grids G1 and G2 (FIG. 1), the four columns of anodes associated with those two activated grids 14 will respond to the display data D1, D2 that has been "latched" by processor 20 onto output lines 36, 37 of anode drivers 16, 18. Thereafter, based on control signal BLKG from processor 20, grid driver 40 successively activates adjacent pairs of grids G2 and G3, G3 and G4, etc., to G1 and G8 (this latter pair of grids being considered "adjacent" according to this description of the operation of this quad-anode system), each time enabling anodes 11 associated with the currently activated grids to respond to the display data D1, D2 on output lines 36, 37 of anode drivers 16, 18. In other words, every time grid driver 40 activates two successive grids 14, grid driver 40 enables four columns of anodes spanning two adjacent grids 14 of display matrix 12 to respond to four columns of display data D1, D2 to display the desired information.

In addition to enabling two grids 14 at a time, to minimize "bleeding" of thermions, known systems must modify the display data D1, D2 that processor 20 sends to anode drivers 16, 18. To understand why known systems must modify the display data, an illustrative example follows. With reference to FIG. 1, system 10 is displaying three numbers "5-3-4," in succession, spanning over five grids G1–G5 14 of display matrix 12.

When grid driver 40 activates grids G3 and G4, the anode associated with activated grid G4 that is connected to output line d2 of anode driver 16 (hereinafter "anode $A_{2,8}$," "2" referring to the row and "8" referring to the column, C8) is supplied with a logic "high" data signal based on the data transmitted by processor 20 to anode driver 16, thus causing that anode to be activated and fluoresce, as it should. However, other anodes connected to output line d2 of anode driver 16, including the anode in row two of column C4 associated with grid G2 (hereinafter "anode $A_{2,4}$"), should not fluoresce. This becomes a problem because output line d2 of anode driver 16 is at logic "high" when grid driver 40 activates grids G3 and G4. As a result, even though anode $A_{2,4}$ is associated with a non-active grid (grid G2), anode $A_{2,4}$ may nevertheless attract thermions and fluoresce because, at that time, it is receiving a logic "high" data signal when grids G3 and G4 are active.

In other words, anodes 11 that should not be fluorescing at a particular instant may still attract thermions if they receive a logic "high" data signal from anode drivers 16, 18, even though those anodes themselves are associated with grids that are not activated. Note that anodes that should not be fluorescing will not likely fluoresce even when they are receiving a logic "high" data signal if they are in a non-activated grid that is not adjacent to an activated grid because they are far enough away from an activated grid that the chance that they will attract thermions is low. As suggested above, this bleeding of thermions typically will occur when the anode receiving a logic "high" data signal is associated with a non-activated grid 14 that is adjacent to an activated grid 14.

To minimize the above-defined bleeding problem associated with displaying four columns of data at once, known systems modify the display data. Specifically, known systems insure that the outer columns of anodes 11 associated with each pair of activated grids 14 (four columns of anodes) are all at logic "low" voltage levels. As a result, anodes associated with non-activated grids 14 adjacent to activated grids, that should not be fluorescing, will also be supplied a logic "low" signal and, therefore, will not likely fluoresce. Turning again to the "5-3-4" example of FIG. 1, system 10 modifies the display data so that output lines a2 and d2 receive a logic "low" data signal when grid driver 40 activates grids G3 and G4, thus minimizing the chance that anodes $A_{2,4}$ and $A_{2,9}$ will fluoresce. As grid driver 40 scans grids 14, system 10 modifies display data D1, D2 so that the inner two columns of anodes associated with each pair of activated grids 14 receive unmodified display data (i.e., data as input to system 10) while the outer two columns of lit anodes associated with those same two activated grids receive logic "low" data signals at any particular instant. In other words, when grid driver 40 activates grids G1 and G2, anodes in columns C2 and C3 respond to the unmodified portion of data D1, D2, while anodes in columns C1 and C4 receive and respond to the modified portion of display data which consists of logic "low" modified data signals. On the next scan, when grid driver 40 activates grids G2 and G3, inner columns C4 and C5 respond to the display data as input to system 10, while anodes in outer columns C3 and C7 receive and respond to the modified a data signals, which again are at logic "low."

Stated another way, by focusing on four output lines a1–d1, processor 20 modifies the display data D1, D2 and transmits that modified data to anode drivers 16, 18 so output lines a1 and d1 of anode driver 16 are at logic "low" while output lines b1 and c1 electrically couple the display data, as it was inputted to system 10, to corresponding anodes 11 when grid driver 40 activates grids G1 and G2. Thereafter, when grid driver 40 activates grids G2 and G3, system 10 modifies the data so lines b1 and c1 receive logic "low" data signals, while lines a1 and d1 receive and transmit the desired display data as it was inputted to system 10, in other words, lines a1 and d1 transmit the unmodified portion of the display data. As a result, as grid driver 40 scans grids 14, thermions do not "bleed" toward anodes associated with non-enabled grids that are adjacent to enabled grids because those anodes will not receive logic "high" data signals even though they would be receiving a logic "high" data signal but for the modification of the display data. Therefore, a clear display results.

Although, the above-described method minimizes thermion bleeding, it comes at the expense of processor time. Known quad-anode systems, such as that described above, modify the display data in the following manner. Upon receipt of serial display data, processor 20 places data D1, D2 in a first memory location and, thereafter, transmits the data to a temporary memory location, i.e., a buffer, so that the first memory location may receive a new string of serial data. Then, processor 20 modifies the data in the temporary memory location by performing an "AND" mask operation on the data to "zero out" particular bits of data in the serial string, consistent with the above description. Specifically, because processor 20 synchronizes transmittal of display data and grid data, processor 20 is able to "mask," i.e., "zero out," the bits of data corresponding to anodes in the outer columns of anodes in grids 14 that are activated at that particular time.

For example, when a string of serial data is sent to processor 20 in the form "11111111 . . . ," processor 20 performs the "AND" mask operation, and then transmits the data to anode drivers 16, 18. (Note that the series of "1"'s represents a string of data bits (all turned on); of course, the bits could be high, logic "1," or low, logic "0.") As a result of this operation, the first string of data sent to the anode driver will read "01100110 . . . ," wherein each "0" represents a data bit that has been "masked" by the "AND" operation and each "1" represents a bit of data that is not masked by the system. Therefore, when grid driver 40 activates G1 and G2 on the first deactivation of grid blanking signal BLKG, the data in columns one and four will be masked (output lines a1 and d1 of anode driver 16 will be at logic "low"), thus anodes 11 in those columns cannot receive a logic "high" data signal and will not fluoresce, even though the unmodified display data would dictate that those anodes should be active.

On the next grid blanking signal, BLKG "low", thus activating G2 and G3, processor 20 will have sent serial display data to anode drivers 16, 18 that reads "10011001 . . . ," processor 20 will have masked the display data for columns C3 and C6 (in the then activated grids G2 and G3) with the "AND" operation, while leaving the data for columns C4 and C5 unmasked (FIG. 1). As a result, the bleeding problem is minimized because each anode associated with a grid that is adjacent to the currently active grids, and which is connected to a data line 36, 37 that is in common with an anode associated with an active grid that is receiving a masked bit of data, cannot receive a logic "high" data signal and, therefore, not fluoresce. Therefore, anodes such as anode $A_{2,4}$ in the above-described example will not be active and will not attract thermions.

For a typical display that has sixteen rows of anodes and two anode drivers that each supply data for one-half of the rows of the display, each anode driver has thirty-two output lines, four for each row of anodes. As a result, thirty-two bits of masked data are sent from processor 20 to anode drivers 16, 18 each time grid driver 40 activates a successive pair of grids 14.

In sum, to display four columns of data in known quad-anode driving systems (in the example immediately above, data for columns two, three, four, and five), processor 20 must send the display data two times, a first time when grid driver 40 activates G1 and G2 (columns C2 and C3) and a second time when grid driver 40 activates G2 and G3 (columns C4 and C5). Also, to minimize "bleeding" of thermions and the attendant fuzzy display, each time processor 20 transmits display data, processor 20 must mask the data to be displayed on the outer columns of anodes associated with each pair of activated grids 14 while anodes associated with the inner columns of anodes respond to the desired unmasked display data.

Therefore, known quad-anode display driving systems have two primary drawbacks that make them inefficient and in some cases expensive to manufacture. First, the processor must perform an "AND" mask operation, thus utilizing valuable processor time. Second, for four columns of anodes to respond to unmasked data, processor 20 must transmit data to both anode drivers two times, similarly utilizing valuable processor time. To perform these functions in certain applications, as in an automobile environment, a separate dedicated processor typically is desired, as opposed to the on-board processor of the vehicle, thus further adding to the inefficiency and expense of known systems.

Therefore, the vacuum fluorescent display market is in need of a quad-anode driver that utilizes a minimum number of required components and which is capable of transmitting and displaying four columns of (unmasked) data with a minimum amount of processing time. With a given CPU speed, the importance of these features increases with the size of the VFD matrix. Preferably, the system will operate in conjunction with the on-board processor of, for example, a vehicle (i.e., without an independent dedicated processor), to drive the anode pixel information of the VFD as fast as possible, while leaving valuable processor time to simultaneously and efficiently perform a variety of other necessary tasks.

SUMMARY OF THE INVENTION

The vacuum fluorescent display (VFD) of the instant invention is designed to provide a clear, high-quality display that exhibits a minimum amount of thermion bleeding. In particular, the VFD of the present invention utilizes a quad-matrix method of driving the display that conserves processor time. Unlike known systems that utilize a quad-matrix method of driving the VFD display, the instant invention minimizes the bleeding of thermions without having the processor perform an "AND" mask operation on the display data nor modify the display data in any way. Because the display data is not "masked," the processor of the instant system need only transmit one time the same amount of data that known systems must transmit two times for the system to ultimately display that amount of data. As a result, the system of the instant invention may operate in conjunction with an on-board processor of, for example, a vehicle, without an independent dedicated VFD processor, while leaving valuable processor time to efficiently perform a variety of other necessary tasks.

To achieve these and other aspects of the invention, the VFD includes at least two anode drivers to selectively activate the anodes of the display matrix. In particular, the anode drivers include a plurality of output lines for supplying display data signals to the anodes. In the preferred embodiment, each row of anodes of the matrix is connected to the output lines of both anode drivers so that each output line associated with a row of anodes is connected to every fourth anode in that associated row. As a result, each anode driver is connected to particular columns of anodes in the matrix. Preferably, every two adjacent columns contained in two grids are connected to a different one of the anode drivers. Further, the VFD may include a plurality of grids positioned between and parallel to the matrix of anodes and perpendicular to a plurality of cathodes. The grids are associated with, preferably, two columns of the anodes that, when activated by the grid driver, direct thermions from the cathode toward the two inner columns of anodes associated with those grids that are receiving a logic "high" data signal from one of the anode drivers.

To synchronize the output of the display data, the processor preferably supplies data to and controls both the anode drivers and the grid driver. When the processor transmits grid data instructing the grid driver to activate particular grids, the processor, every other time that the grid driver activates particular grids, nearly simultaneously transmits display data corresponding to those grids to the anode drivers. Therefore, as the grid driver scans, i.e., activates the grids, preferably two grids at a time, the anode drivers output the corresponding display data to the anodes associated with the currently activated grids, thus displaying the desired data.

To minimize the bleeding of thermions from the system cathode toward anodes associated with deactivated grids adjacent to activated grids, the processor alternatingly transmits a blanking signal to the anode drivers. In operation, particular columns of anodes are connected to one of the anode drivers and respond to the display data output by that anode driver, while other columns of anodes respond to logic "low" data signals from another of the anode drivers due to the blanking signal applied to the output of that anode driver. Therefore, anodes associated with deactivated grids that are adjacent to activated grids will not receive a logic "high" data signal and, therefore, will not attract bleeding thermions.

In operation, the processor transmits grid data and display data to the grid driver and anode drivers, respectively. Thereafter, in the preferred embodiment, with the output of one of the anode drivers held at logic "0," i.e., disabled, the processor enables the output of the other anode driver. As the system scans the anodes of the matrix, the processor alternatingly deactivates the output of the anode drivers so the enabled anodes that receive display data from the currently enabled anode driver at that time will fluoresce accordingly without bleeding.

The processor repeats the above sequence of operations, thus enabling anodes associated with activated grids to fluoresce in response to the display data transmitted by the currently enabled anode driver, while anodes associated with the currently disabled anode driver are deactivated to minimize thermion bleeding. Contrary to prior art systems which must mask and transmit new display data two times each time a predetermined amount of data is to be displayed, the processor of the instant system transmits new display data, unmodified by the processor, only one time for that same predetermined amount of data to be displayed. As a result, valuable processor time is available for performing a variety of other tasks without requiring a separate processor dedicated to operating the VFD.

In an alternate embodiment of the invention, the connections between the anode drivers and the anodes remain the same as the conventional system shown in FIG. 1. However, each anode driver is reconfigured to disable particular output lines (the output lines connected to the outer columns of anodes in the currently activated grids) of that anode driver, and it does so according to the same blanking signals utilized by the preferred embodiment. Therefore, a conventional quad-matrix connection structure may be used, yet still achieve the advantages of the preferred embodiment.

These and other features, advantages and objects of the present invention will be further understood and appreciated by those skilled in the art by reference to the following specification, claims and appended drawings.

DETAILED DESCRIPTION OF PREFERRED EMBODIMENT

Figure 3:
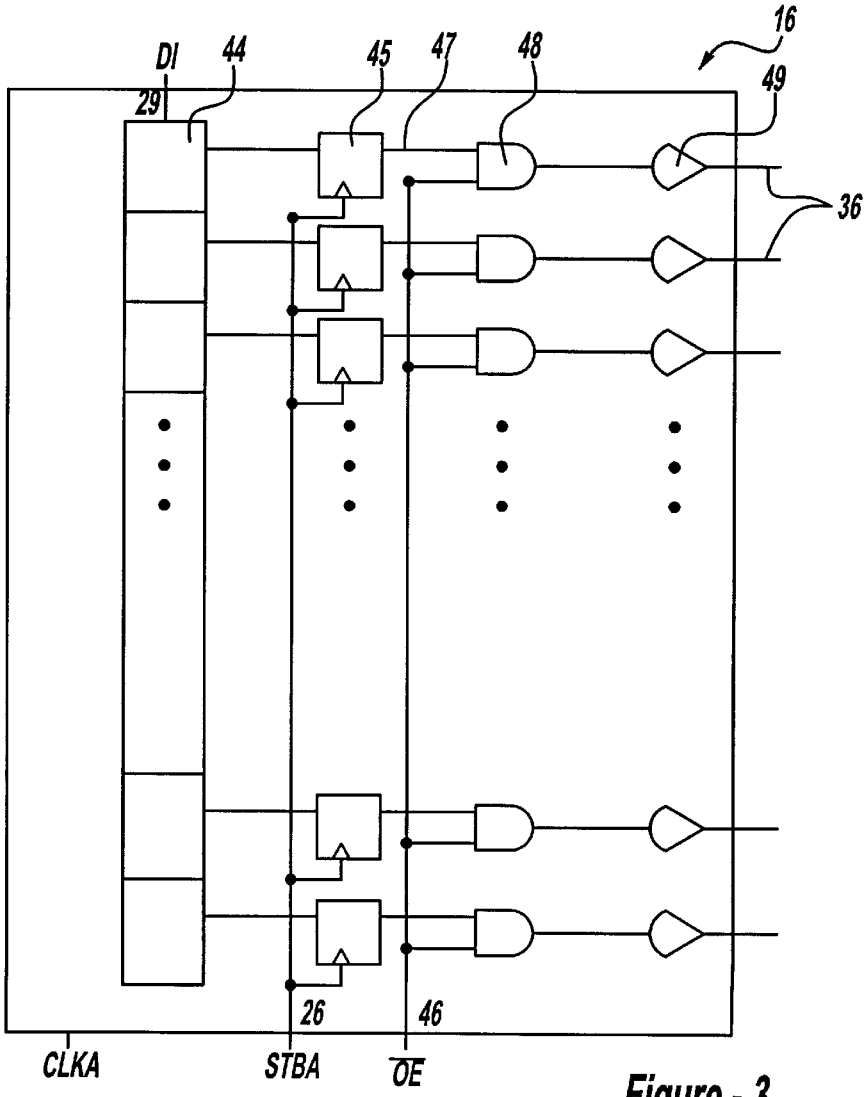
Figure - 3 Prior Art
FIG. 3 is a circuit diagram showing the components of a conventional anode driver utilized in the instant invention.
Figure 4:
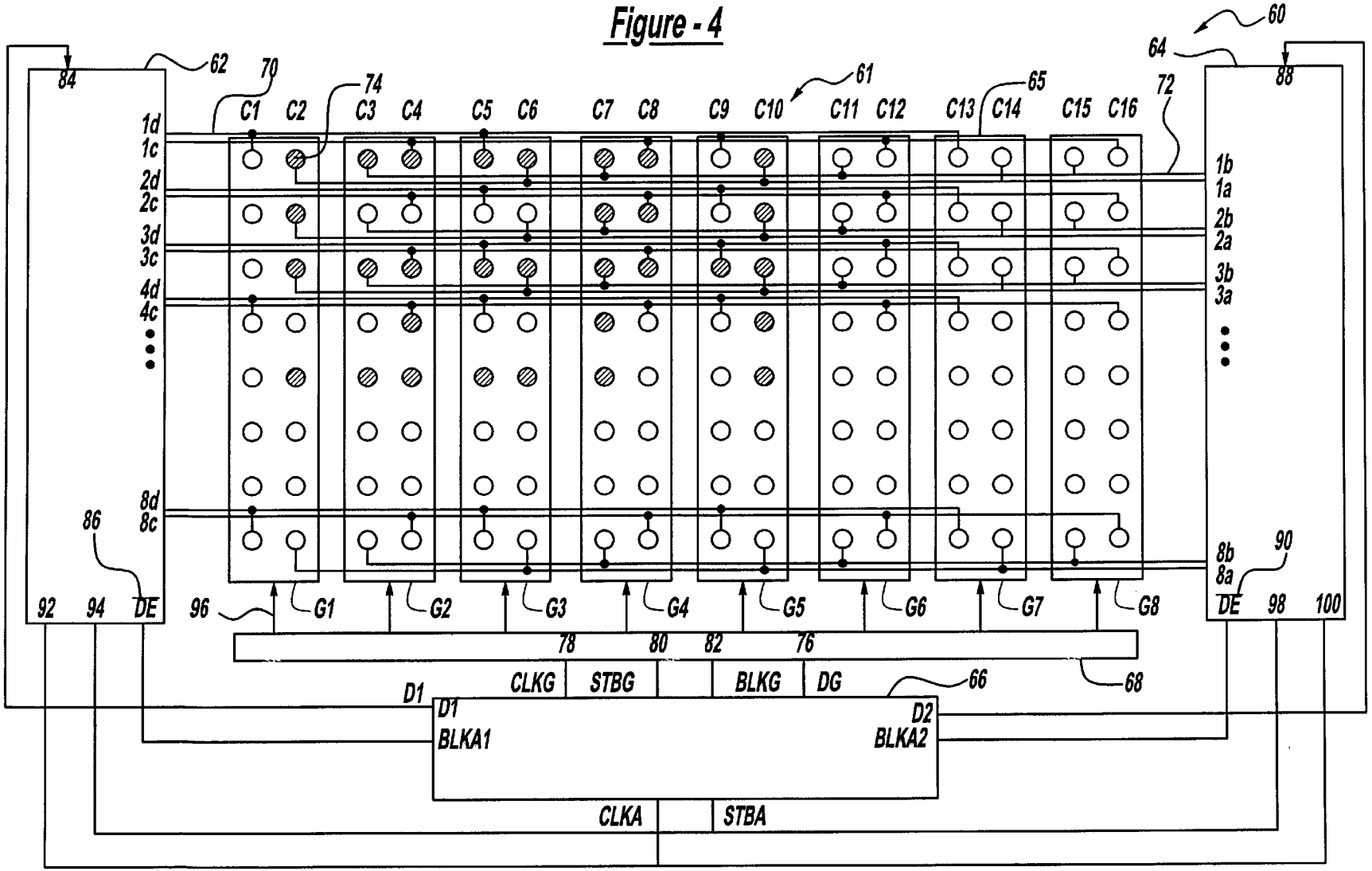
FIG. 4 is a block diagram showing the components of a quad-matrix driving system for a simplified 8×16 display according to the instant invention.

Referring in more detail to the drawings, FIG. 4 shows the principal components of the preferred embodiment of a vacuum fluorescent display (VFD) according to the instant invention that utilizes a quad-matrix method of driving the system 60. In particular, in the preferred embodiment, system 60 of the instant invention includes a first anode driver 62 and a second anode driver 64 for supplying display data to a plurality of anodes 74 arranged in a matrix 61 consisting of rows and columns C1–C16 of anodes 74. Anode drivers 62, 64 are identical to the anode driver shown in FIG. 3 and described previously with respect to the conventional system shown in FIG. 1, and are fabricated in a display module for a VFD.

Figure 6:
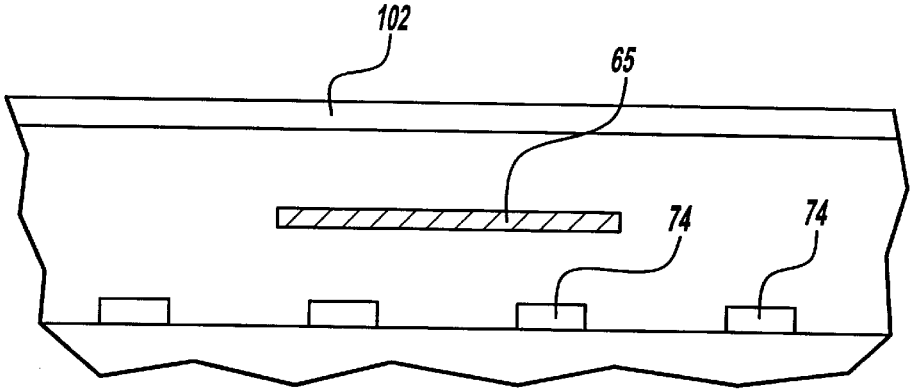
FIG. 6 is a sectional side view of the primary display components of the preferred embodiment shown in FIG. 4.

In addition, system 60 includes a series of grids 65 being positioned between matrix 61 and a plurality of filament cathodes 102 (FIG. 6). Each grid 65 is associated with two columns of anodes 74 of matrix 61 and functions to attract thermions emitted by the cathode toward activated anodes 74, thus causing those anodes to fluoresce. To activate grids G1–G8, system 60 includes a grid driver 68 that supplies particular grid data signals to grids 65, via a plurality of output lines 96. System 60 also includes a processor 66 that supplies the display data and the grid data to anode drivers 62, 64 and grid driver 68, respectively. In addition to supplying the data, processor 66 controls grid driver 68 and anode drivers 62, 64 to synchronize the output of the drivers to display the desired data. Unlike the separate dedicated processor of the prior art system, processor 66 is preferably the on-board system processor for that particular operating environment, e.g., an automobile.

As described above with respect to the conventional system, because a quad-matrix method of driving the display data is utilized, grid driver 68 preferably will activate only two grids 14 at any instant and, therefore, anode drivers 62, 64 need only supply display data to the inner two columns of anodes that are associated with the activated grids at that time. Therefore, in the instant quad-matrix connection structure, as in the quad-matrix connection structure shown in FIG. 1, only four output lines 70, 72 need be provided per row of anodes 74 for anode drivers 62, 64 to supply display data to an entire row of anodes, provided the display data on lines 70, 72 is changed in synchronism with the activation of each pair of grids. Nevertheless, unlike the conventional system shown in FIG. 1, rather than having one anode driver supply display data to an entire row of anodes via four output lines from that anode driver (e.g., so one anode driver drives the top half of the display and the other anode driver drives the bottom half of the display), both anode drivers 62, 64 supply display data to each individual row of anodes 74. As shown in FIG. 4, rather than only one anode driver supplying display data to any particular row of anodes, only one anode driver 62, 64 of system 60 supplies display data to any particular column of anodes.

For each row of anodes in the instant system, two output lines 70 of anode driver 62 and two output lines 72 of anode driver 64 supply the display data to that row. Therefore, each anode driver 62, 64 has sixteen output lines 70, 72, two for each row of anodes 74, such that left anode driver 62 supplies data to columns C1, C4–C5, C8–C9, etc., and right anode driver 64 supplies display data to anodes in columns C2–C3, C6–C7, etc.

By connecting anodes 74 to anode drivers 62, 64 in the above fashion and alternatingly disabling output from anode drivers 62, 64 (described below) as we scan the grids, system 60 minimizes "bleeding" of thermions and efficiently utilizes valuable processor time. The advantages realized with the instant system will be readily apparent from the description of the operation of system 60 described below.

Figure 5:
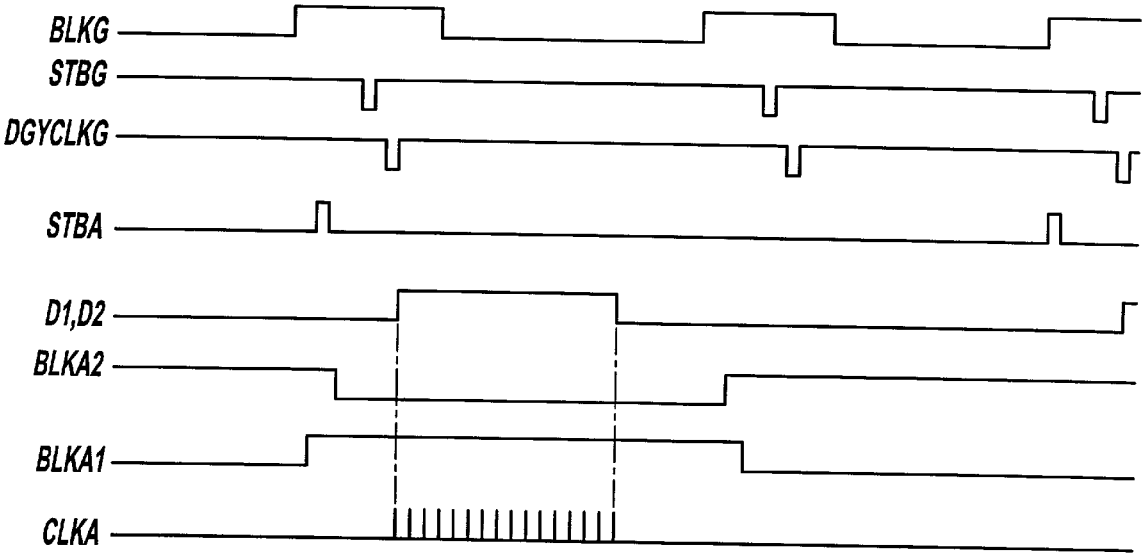
FIG. 5 is a timing diagram explanatory of the operation of the system of the instant invention shown in FIG. 4.

With further reference to FIGS. 4 and 5, operation of system 60 is as follows. Initially, processor 66 transmits grid data signals DG to input port 76 of grid driver 68 according to a clock signal CLKG supplied by processor 66 to input port 78. Then, processor 66 transmits anode driver display data signals D1 and D2 to input port 84 of first anode driver 62 and input port 88 of second anode driver 64, respectively, according to a common clock signal CLKA supplied to anode driver input ports 92, 100, respectively. Notably, although processor 66 may transmit display data signals D1, D2 for the entire matrix to anode drivers 62, 64 at the same time, one of ordinary skill in the art will appreciate that the data may be independently transmitted, possibly in portions, to each of the anode drivers, as long as the anode drivers have received the display data corresponding to the currently activated grids (described below).

After the anode data (D1, D2) is sent to the anode driver shift registers, DG (grid data) is loaded into the grid driver (FIG. 3), and then processor 66 transmits an anode driver blanking signal BLKA2 to the output enable (OE) (46 in FIG. 3) port 90 of second anode driver 64. When anode blanking signal BLKA2 is at a logic "high" level, it blanks, i.e., pulls, preferably, to ground, output lines 72 of anode driver 64. Note that OE input 46 is an inverted signal so that when anode blanking signals BLKA1, BLKA2 are at logic "high," a low level voltage is supplied to "AND" gates 48 (FIG. 3). With the output of second anode driver 64 disabled, processor 66 transmits a grid blanking signal BLKG (logic level "high") to port 82 of grid driver 68 to deactivate grids G1–G8. Then, processor 66 transmits an anode driver blanking signal BLKA1 having a high logic level to OE port 86 of first anode driver 62 to disable output lines 70. With the output of both anode drivers 62, 64 disabled, processor 66 transmits a strobe signal STBA to input ports 94, 98 of anode drivers 62, 64, thus latching the previously delivered display data D1, D2 in both anode driver shift registers onto, as shown in FIG. 3, output lines 47 of latch gates 45.

Next, with the output of both anode drivers 62, 64 still disabled but having data prepared for display, processor 66 changes the logic level of anode blanking signal BLKA2 to a logic "low" level, thus enabling second anode driver 64. However, because grids 65 are still blanked, anodes 74 connected to output lines 72 of second anode driver 64 will not fluoresce, even though they may be receiving a logic "high" data signal from enabled second anode driver 64.

Prior to enabling grid driver 68 by pulling BLKG "low," processor 66 transmits a strobe signal STBG to port 80 of grid driver 68 to latch the previously set grid data DG from the grid driver shift register to output lines 96 of grid driver 68. In addition, processor 66 transfers the next set of grid data DG into the grid shift register in response to grid clock signal CLKG. The data in the grid shift register is loaded so that the next pair of adjacent grids is enabled. And, because the initially loaded display data D1, D2 has been latched onto output lines 47 of latch gates 45 (FIG. 3), processor 66 begins to transmit the next set of anode driver data D1, D2 into the respective empty shift registers of anode drivers 62, 64. As discussed in further detail below, processor 66 will activate pairs of the grids by pulling the blanking signal BLKG "low" two times before this new data will begin to be output by system 60.

While transmitting the next string of serial display data D1, D2 to anode drivers 62, 64, processor 66 pulls the grid blanking signal BLKG "low", thus initially activating grids G1 and G2 (in response to latched grid data signals DG) to enable anodes 74 in columns C1–C4. As a result, with first anode driver 62 disabled by anode blanking signal BLKA1 and second anode driver 64 enabled, anodes in columns C1 and C4 will be at a logic "0" voltage level and anodes in columns C2 and C3 will respond to the display data D2 on the enabled output lines 72 of second anode driver 64. Because processor 66 synchronizes the transmission and output of the data, including display data D1, D2 and grid data DG, the appropriate anodes in the enabled columns of anodes in matrix 61 will fluoresce as grid driver 68 successively scans pairs of grids 65.

The next time that grid blanking signal BLKG is pulled "low," grid driver 68 will activate grids G2 and G3 in response to grid data DG to enable anodes in columns C3–C6. Prior to activation of grids G2 and G3, BLKG goes "high" to disable all grids, and then processor 66 will pull second anode driver blanking signal BLKA2 "high" to disable output from second anode driver 64. Further, processor 66 pulls the first anode driver blanking signal "low" to enable output from first anode driver 62. As a result, anodes in columns C3 and C6 will be at a logic "low" voltage level, preferably ground, while anodes in columns C4 and C5, connected to lines 70 of left anode driver 62, will soon respond to the initially loaded display data D1 that has been latched, amplified and transmitted to output lines 70 of first anode driver 62. Prior to enabling grid driver 68 by pulling BLKG "low," processor 66 transmits a strobe signal STBG to port 80 of grid driver 68 to latch the previously set grid data DG from the grid driver shift register to output lines 96 of grid driver 68. In addition, processor 66 transfers the next set of grid data DG into the grid shift register in response to grid clock signal CLKG. The data in the grid shift register is loaded so that the next pair of adjacent grids is enabled. Thereafter, grid blanking signal is pulled "low" to activate grids G2 and G3 and enable anodes associated with these grids to fluoresce.

As processor 66 latches data to either the first or second anode drivers 62, 64, grid driver 68 activates appropriate grids 65 to ensure that the outer columns of anodes associated with each pair of activated grids 65 are deactivated, i.e., connected to the anode driver that is currently receiving a logic "high" anode blanking signal (BLKA1 or BLKA2) to disable the output of that anode driver, while the inner adjacent columns of anodes associated with each pair of activated grids receive the latched display data, from the currently enabled anode driver. With the outer columns of anodes of each two adjacent grids alternatingly connected to anode drivers 62, 64, system 60 insures that the outer columns of anodes are deactivated by alternatingly disabling the output from anode drivers 62, 64 with anode blanking signals BLKA1 and BLKA2, as depicted in the timing diagram shown in FIG. 5. Because processor 66 controls the drivers 62, 64, 68, processor 66 "knows" which anode driver is driving the outer columns of enabled anodes in the two currently activated grids as it alternatingly blanks anode drivers 62, 64 and, therefore, supplies display data D1, D2 accordingly.

When grid data DG instructs grid driver 68 to activate grids G1 and G8, system 60 considers anode columns C1 and C16 to be "adjacent," i.e., anodes in columns C1 and C16 respond to display data D1 from first anode driver 62, while anodes in columns C2 and C15 are deactivated at a logic "low" voltage level due to blanking signal BLKA2 transmitted by processor 66 at that time.

By deactivating the outer columns of the four columns of enabled anodes, system 60 prevents thermions from bleeding toward anodes associated with disabled grids adjacent to enabled grids that would otherwise receive a logic "high" data signal from their respective anode drivers but for the anode blanking signal BLKA1 or BLKA2 supplied to the anode driver connected to such anodes. The example described above in the Background will hereinafter be described with respect to the inventive system to highlight its advantages.

Focussing on the display data for columns C2–C5 and assuming all anodes to be on, when grid driver 40 of prior art (FIG. 1) system 10 activates grids G1 and G2, the display data input to processor 20, which is subsequently modified by the processor "AND" masking operation (described in the background), will read "0001-0111-0100-0111" (data bits "0111" correspond to output lines a1–d1, respectively, of left anode driver 16, etc.), and the display data input to right anode driver will read "0000-0000-0000-0111" (data bits "0111" correspond to output lines aa1–dd1, respectively, of second anode driver 18, etc.). Next, when grid driver activates grids G2 and G3, the corresponding display data input to processor 20 for left anode driver will read "0001-1111-0000-1111" and for right anode driver "0000-0000-0000-1111." As is readily apparent from a comparison of these two strings of display data sent to each anode driver, the known quad-matrix method of driving the system shown in FIG. 1 consists of transmitting two different sets of display data to the anode drivers to display what amounts to four columns of display data; in this case, first transmitting the display data for columns C2 and C3 when grids G1 and G2 are activated, i.e., first time the grid blanking signal BLKG is deactivated (anodes in columns C1 and C4 being "zeroed out"), and, second, transmitting the display data for columns C4 and C5 when grids G2 and G3 are activated (anodes in columns C3 and C6 being "zeroed out") the next time the grid blanking signal is deactivated.

To the contrary, when processor 66 of the preferred embodiment enables grid driver 68 of instant system 60, thus initially activating grids G1 and G2, the display data sent to left anode driver 62 reads, for the "5-3-4" example, " . . . 00–10" (data bits "00–10" correspond to output lines 2*c*, 2*d*, 1*c*, 1*d*, respectively) and the display data sent to second anode driver 64 reads " . . . 10–11" (data bits "10–11" correspond to output lines 2*a*, 2*b*, 1*a*, 1*b*). Thereafter, when processor 66 instructs grid driver 68 to activate grids G2 and G3, the display data output signals for anode drivers 62, 64 reads the same as just noted, i.e., " . . . 00–10" for first anode driver 62 and " . . . 10–11" for second anode driver 64. Therefore, although the processor of each system transmits sixteen bits of data to each of the anode drivers, processor 66 does not transmit new display data each time it activates the next two successive grids. In other words, unlike the conventional system shown in FIG. 1, processor 66 does not have to transmit a new string of serial display data each time it pulls grid blanking signal BLKG to a logic "low" voltage level.

Figure 1:
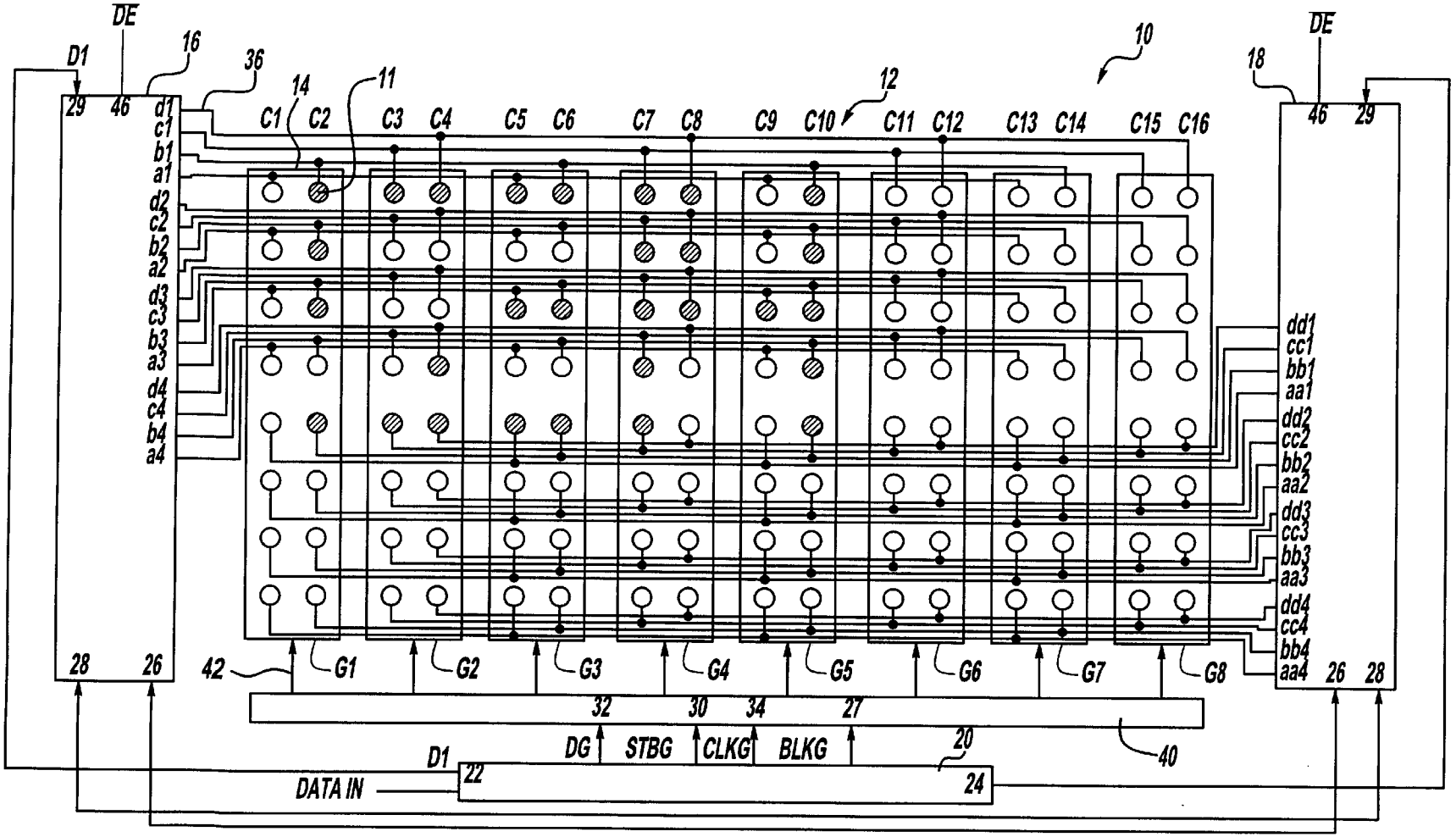
Figure - 1 Prior Art
FIG. 1 is a block diagram showing a conventional quad-matrix driving system for a simplified conventional 8×16 fluorescent display.
Figure 2:
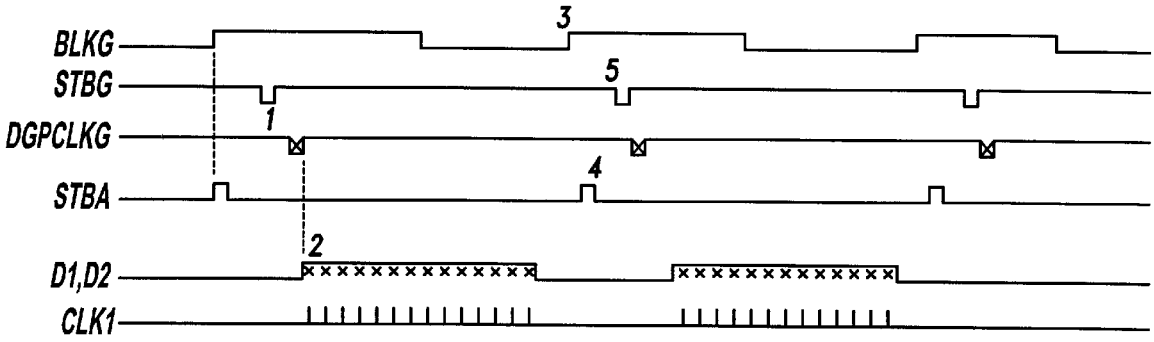
Figure - 2 Prior Art
FIG. 2 is a timing diagram explanatory of the operation of the conventional system shown in FIG. 1.

This principal is highlighted by comparing the timing diagram shown in FIG. 5 for system 60 verses the timing diagram of the conventional system shown in FIG. 2. Every time processor 20 of prior art system 10 pulls the grid blanking signal BLKG to a logic "low" voltage level to enable grid driver 40, processor 20 must transmit sixteen bits of masked display data to anode drivers 16, 18. To the contrary, each two times that processor 66 pulls grid blanking signal BLKG "low," processor 66 transmits only one string of serial display data. In other words, in the preferred embodiment, processor 66 transmits a new string of serial display data every other time that it deactivates grid blanking signal to activate a new pair of grids 65. The processor of the known system of FIG. 1, on the other hand, transmits a new string of serial display data every time it deactivates grid blanking signal BLKG.

In sum, by alternatingly disabling anode drivers 62, 64 to deactivate the outer columns of anodes, processor 66 neither has to modify, i.e., mask, the serial display data with "AND" operations nor transmit the display data twice for each four columns to be displayed with a minimum "bleeding" of thermions. The time saved sending display data signals half as often as known quad-matrix driving systems, without having to modify the display data that is sent, allows processor 66 sufficient time to perform a variety of other tasks such as functioning as a compass controller and/or trip computer, thus eliminating the need for a separate dedicated processor.

Figure 7:
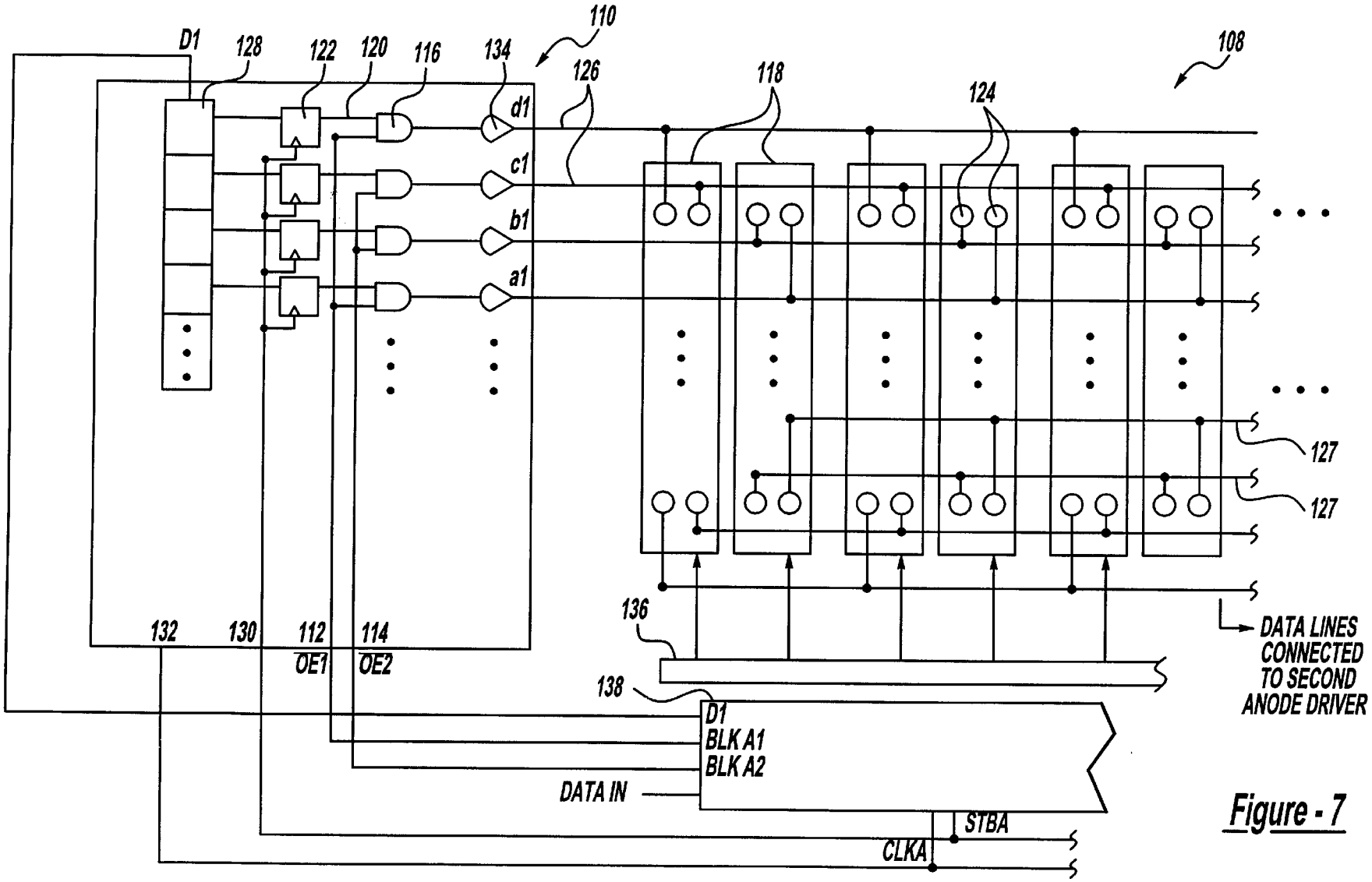
FIG. 7 is a partial block diagram showing the components of an alternate embodiment of a quad-matrix driving system including a circuit diagram showing the components of the first anode driver of the alternate embodiment.

In an alternate embodiment of the instant invention, the connections between the output lines of the anode drivers and the anodes of the display matrix remain the same as the known system shown in FIG. 1. Specifically, four output lines of one of the anode drivers are connected to the anodes in one particular row of the matrix, each line connected to every fourth anode in that row, such that a first anode driver supplies display data to the top half of the matrix (the top four rows of a simplified conventional 8×16 VFD) and a second anode driver supplies display data to the bottom half of the matrix of anodes. However, in the alternate embodiment, the advantages of the preferred embodiment are realized by reconfiguring the anode drivers. As shown in FIG. 7, a first anode driver 110 supplies display data via output lines 126 to anodes 124 in the rows in the top half of the display matrix. First anode driver 110 is nearly identical to the conventional anode driver shown in FIG. 3, including a shift register 128, a data clock signal port 132 and a strobe signal port 130, except for having two output enable input ports 112, 114 that are connected to either the top or bottom "AND" gate of that anode driver (as shown in FIG. 7) and each two successive "AND" gates 116. For example, port 112 is connected to the top gate (connected to output line d1) and port 114 is connected to the next two gates under the top gate, and port 112 is connected to the next two gates, etc. By supplying the same blanking signals BLKA1, BLKA2 utilized by the preferred embodiment (FIG. 5) to the two output enable input ports 112, 114, system 108 "blanks" the outer columns of anodes of the currently activated grids 118. The second anode driver (not shown in FIG. 7) of system 108 is configured in the same way and is shown on the right side but could be on the left as well.

Overall, even though it uses a conventional quad-matrix connection structure, the operation of system 108 is nearly identical to the operation of the preferred embodiment as depicted in the timing diagram of FIG. 5 and described above. However, rather than sending anode driver blanking signal BLKA1 to the first anode driver and anode driver blanking signal BLKA2 to the second anode driver to alternatingly "blank" the entire output of the anode drivers, processor 138 transmits blanking signals BLKA1, BLKA2 to both anode drivers to "blank" some of the output lines of both anode drivers. In particular, processor 138 transmits blanking signals BLKA1, BLKA2 to separate output enable ports OE1 and OE2 of both anode drivers to disable the output lines connected to the outer columns of anodes associated with the currently activated grids. For example, when system 108 activates grids G1 and G2, processor 138 transmits a logic "high" blanking signal BLKA1 to output enable input port 112 of anode driver 110 and transmits a logic "low" anode blanking signal BLKA2 to output enable input port 114 of anode driver 110. As a result, the display data D1 (for columns C2 and C3) on the output lines 120 of the latch gates 122 is transmitted through "AND" gates 116, amplified by amplifiers 134, and then transmitted to the anodes in columns C2 and C3 that are connected to output lines 126 of first anode driver 110. Similarly, the anodes in columns C2 and C3 that are connected to output lines 127 of second anode driver (not shown) simultaneously receive and respond to display data.

In sum, unlike the conventional system shown in FIG. 1, processor 138 does not transmit new display data each time it activates the next two successive grids. Just as in the preferred embodiment, processor 138 does not have to transmit a new string of serial display data each time it pulls grid blanking signal BLKG to a logic "low" voltage level. As a result, system 108 minimizes the bleeding of thermions yet permits processor 138 to perform other tasks, thus eliminating the need for a separate dedicated processor to drive the VFD.

Further, although anode driver 110 shown in FIG. 7 has two input ports OE1 and OE2 that receive a different blanking signal BLKA1 and BLKA2, respectively, anode driver 110 could include only one OE input (as shown in FIG. 3) that receives one blanking signal from processor 138, with an inverter placed between the input leads attached to ports 112, 114 of FIG. 7.

Although the present invention has been described above as using two anode drivers, it will be appreciated by those skilled in the art that additional anode drivers may be used without departing from the spirit and scope of the present invention. By using additional anode drivers, the size of the display may be increased accordingly. Also, although the system has been described as being operated entirely by the processor, those skilled in the art will appreciate that a separate dedicated circuit that cooperates with the processor could be included for transmitting at least some of the control signals described above to lessen the amount of functions that the processor is required to perform and, therefore, more efficiently utilize valuable processor time. Further, according to another alternative of the embodiment shown in FIG. 7, one anode driver chip could be used to drive a display having a limited number of anodes, for example, an 8×1 display.

The above description is considered that of the preferred embodiments only. Modifications of the invention will occur to those skilled in the art and to those who make or use the invention. Therefore, it is understood that the embodiments shown in the drawings and described above are merely for illustrative purposes and not intended to limit the scope of the invention, which is defined by the following claims as interpreted according to the principles of patent law, including the doctrine of equivalents.

The embodiments of the invention in which an exclusive property or privilege is claimed are defined as follows:

1. A quad-anode fluorescent display comprising:

a plurality of anodes arranged in a matrix of rows and columns;

at least two anode drivers, each having a plurality of output lines, for supplying display data signals to said anodes, each row of anodes of said matrix being supplied with said display data signals from said anode drivers, wherein at least two anodes in any row of said matrix are connected to one of said output lines of one of said anode drivers and at least one of said anodes between said two anodes is connected to one of said output lines of a different one of said anode drivers; and a processor coupled to said anode drivers for transmitting display data signals to said anode drivers and alternatingly disabling the output signals from said anode drivers.

2. A quad-anode fluorescent display according to claim 1, wherein each said output line associated with a row of said anodes is connected to every fourth anode in that row.

3. A quad-anode fluorescent display according to claim 2, wherein each said row of anodes is associated with two said output lines of each said anode driver such that said two associated output lines are connected to adjacent anodes.

4. A quad-anode fluorescent display according to claim 1, further comprising:

a plurality of grids for directing thermions emitted by a cathode toward associated columns of said anodes; and a grid driver for successively activating said grids, two adjacent grids at a time, to enable a plurality of columns of said anodes associated with said activated grids to receive thermions, said plurality of columns of enabled anodes including inner columns of anodes and outer columns of anodes, wherein said processor alternatingly disables said anode drivers such that when said grid driver activates said two adjacent grids, said processor disables the anode driver that is connected to said anodes associated with said outer columns of enabled anodes.

5. A quad-anode fluorescent display according to claim 4, wherein each said output line associated with any one row of said anodes is connected to every fourth anode in that associated row of said anodes such that, for any of said two adjacent activated grids, said output lines of one of said anode drivers are connected to said outer columns of enabled anodes, and said output lines of another of said anode drivers are connected to said inner columns of said enabled anodes.

6. A quad-anode fluorescent display according to claim 5, wherein said outer columns of enabled anodes includes two columns of anodes and said inner columns of enabled anodes includes two adjacent columns of anodes.

7. A quad-anode fluorescent display according to claim 1, further comprising a plurality of grids, each said grid associated with two adjacent columns of said anodes, and wherein each said output line associated with any one row of said anodes is connected to every fourth anode in that associated row of said anodes such that adjacent anodes in a row of said anodes that are positioned across two adjacent said grids form a pair of anodes, wherein each said pair of anodes in any particular row of anodes are alternatingly connected to said at least two anode drivers.

8. A quad-anode fluorescent display comprising:

a plurality of anodes arranged in a matrix of rows of columns; and first and second anode drivers, each having a plurality of output lines, for supplying display data signals to said anodes, each row of anodes of said matrix being supplied with said display data signals from both said first and second anode drivers, wherein at least two of said anodes in any row of said matrix are connected to an output line of said first anode driver and at least one of said anodes in between said at least two anodes is connected to an output line of said second anode driver.

9. A quad-anode fluorescent display according to claim 8, wherein each said output line of said first and second anode drivers is connected to every fourth anode in a particular row of said matrix.

10. A quad-anode fluorescent display according to claim 9, wherein each said output line of said first and second anode drivers is connected to adjacent anodes in a particular row of said matrix.

11. A quad-anode fluorescent display according to claim 8, further comprising:

a plurality of grids for directing thermions emitted by a cathode toward associated columns of said anodes; and a grid driver for successively activating said grids, two adjacent grids at a time, to enable a plurality of columns of said anodes associated with said activated grids to receive thermions, said plurality of columns of enabled anodes including inner columns of anodes and outer columns of anodes.

12. A quad-anode fluorescent display according to claim 11, wherein each said grid is associated with two adjacent columns of said anodes so that when said grid driver successively activates said grids, two adjacent grids at a time, said grid driver enables four adjacent columns of said anodes, including two adjacent inner columns of anodes, one column in each said activated grid, and two outer columns of anodes.

13. A quad-anode fluorescent display according to claim 12, wherein each said output line of said first and second anode drivers is connected to every fourth anode in any one row of said anodes such that, for any of said two adjacent grids activated by said grid driver, said output lines of one of said anode drivers are connected to said outer columns of anodes associated with said two adjacent activated grids at that time, and said output lines of the other of said anode drivers are connected to said inner columns of said anodes associated with said two adjacent activated grids at that time.

14. A quad-anode fluorescent display according to claim 8, further comprising a plurality of grids, each said grid associated with two adjacent columns of said anodes, and wherein each said output line is connected to every fourth anode in a corresponding row of said anodes, such that consecutive anodes in a row of said anodes of said matrix that are positioned across two adjacent said grids form a pair of anodes, wherein each said pair of anodes in any particular row of anodes are alternatingly connected to said anode drivers.

15. A quad-anode fluorescent display according to claim 8, further comprising a processor for alternatingly disabling the output lines of said first and second anode drivers so that said anodes connected to said disabled output lines cannot fluoresce.

16. A quad-anode fluorescent display according to claim 11, further comprising a processor for alternatingly disabling the output lines of said first and second anode drivers with each activation of two adjacent grids so that said anodes connected to said disabled output lines cannot fluoresce.

17. A quad-anode fluorescent display comprising:

a plurality of anodes arranged in a matrix of rows of columns; and at least two anode drivers, each said anode driver having a plurality of output lines for supplying display data signals to said anodes, each row of anodes of said matrix being supplied with said display data signals from said anode drivers, wherein anodes in between any two consecutive anodes in one row that are connected to output lines of one of said anode drivers associated with that row are connected to output lines of a different one of said anode drivers associated with that row.

18. A method of driving a quad-anode fluorescent display having a plurality of anodes arranged in a matrix of rows and columns and two anode drivers for supplying output display data signals to the anodes via a plurality of output gates, the method comprising the steps of:

transmitting the output display data signals to the anode drivers; and alternatingly disabling at least some of the output gates of the anode drivers, such that the anodes connected to the disabled output gates are deactivated while the anodes connected to the remaining output gates receive and are responsive to the output display data.

19. The method according to claim 18, further comprising the step of successively activating a plurality of grids, each grid being associated with at least two columns of anodes in the matrix, two adjacent grids at a time, to enable at least four of the columns of anodes, said at least four columns of enabled anodes including outer columns of anodes and inner columns of anodes, and wherein said step of alternatingly disabling at least some of the output gates of the two anode drivers includes deactivating said outer columns of enabled anodes.

20. The method according to claim 18, further comprising the step of successively activating a plurality of grids, each grid being associated with two columns of anodes in the matrix, two adjacent grids at a time, to enable four of the columns of anodes, said four columns of enabled anodes including two outer columns of anodes and two adjacent inner columns of anodes, and wherein the step of alternatingly disabling at least some of the output gates of the anode drivers includes deactivating said two outer columns of enabled anodes.

21. A quad-anode fluorescent display comprising:

a plurality of anodes arranged in a matrix of rows of columns for becoming activated or deactivated in response to display data when enabled;

a plurality of grids each grid associated with at least two adjacent columns of said anodes;

first and second anode drivers having a plurality of output lines, said output lines being connected to said anodes for supplying said display data to said anodes;

a grid driver for selectively activating said grids, two adjacent grids at a time, thereby enabling four columns of anodes associated with said activated grids to respond to said display data, including two inner adjacent columns of enabled anodes and two outer columns of enabled anodes; and a processor for alternatingly disabling the output of said display data from said first and second anode drivers such that said two outer columns of enabled anodes are deactivated.

22. A quad-anode fluorescent display comprising:

a plurality of anodes arranged in a matrix of rows and columns;

a series of grids each associated with two adjacent columns of said anodes;

a grid driver for successively activating said grids, at least two adjacent grids at a time thus enabling four columns of said anodes including two inner columns of anodes and two outer columns of anodes;

first and second anode drivers having a plurality of output lines for transmitting display data to said matrix of anodes, wherein each said output line of said first and second anode drivers is connected to every fourth anode in a corresponding row of said anodes such that every two adjacent anodes in a row of said anodes that are positioned across two adjacent grids form a pair of anodes, each said pair of anodes being alternatingly connected to said first and second anode drivers; and a processor for transmitting the display data to said first and second anode drivers, and for alternatingly disabling and enabling the output of display data from said first and second anode drivers such that when said grid driver activates said two adjacent grids, said processor disables the output of display data from the anode driver that is connected to the anodes associated with the two outer columns of enabled anodes while enabling the other anode driver to output display data to the two inner columns of enabled anodes.

* * * * *